United States Patent [19]

Pieters

[11] 4,023,580

[45] May 17, 1977

[54] PLAQUE MARKER TOOTHBRUSH KIT

[75] Inventor: Eli Pieters, Brooklyn, N.Y.

[73] Assignee: Lawrence Peska Associates, Inc., New York, N.Y. ; a part interest

[22] Filed: Apr. 14, 1976

[21] Appl. No.: 677,015

[52] U.S. Cl. ..... 132/84 A
[51] Int. Cl.[2] ..... A45D 44/18
[58] Field of Search ..... 132/84 R, 84 A

[56] References Cited

UNITED STATES PATENTS

| | | | |
|---|---|---|---|
| 2,634,025 | 4/1953 | Hausner | 132/84 R |
| 2,699,889 | 1/1955 | Johnson | 132/84 R |
| 2,968,827 | 1/1961 | Lawsine et al. | 132/84 R |

*Primary Examiner*—G.E. McNeill
*Attorney, Agent, or Firm*—Wenderoth, Lind & Ponack

[57] ABSTRACT

A plaque marker toothbrush kit comprising a brush head, a felt tip marker, and a cover cap with a clip.

4 Claims, 4 Drawing Figures

PLAQUE MARKER TOOTHBRUSH KIT

BACKGROUND OF THE INVENTION

1. Field of the Invention

This invention relates to toothbrushes and, in particular, to toothbrush kits for comfortable pocket transportation. More particularly, it pertains to toothbrushes for use with oral or dental chemicals such as for plaque indication.

2. Prior Art

Many toothbrush designs have been available. Quite a number of convenience toothbrushes have been disclosed. Applicant is not, however, aware of any toothbrush kits suitable for use with any desired chemicals other than toothpaste.

The following U.S. Pat. Nos. were found in a search made upon this invention prior to writing this application:

RIVERO 2,900,650; PERWAS 2,599,658 and 2,317,111; RIDNER 2,620,500; HAMEL 2,053,145; BAULER 2,124,647; MAURO 2,521,928; LODEWICK 2,701,381.

It is therefore an object of this invention to overcome the limitations and disadvantages in the toothbrush devices in the prior art and currently available in the market.

SUMMARY

One of the objects of the invention is to provide a toothbrush embodying improved principles of design and construction.

An important object of the invention is to provide a toothbrush device which is comprised of a minimum number of simple durable parts and components which can be economically manufactured and readily assembled.

A significant object of the invention is to provide a toothbrush device, so designed and constructed that it can be readily applied with almost any typical oral chemical now in use.

Another object of the invention is to provide a means for applying plaque marking chemicals to specific oral areas.

A toothbrush kit, according to the principles of this invention, comprises a toothbrush head, a flexible soft tipped marker, and a cover cap with a clip.

Further objects and advantages of this invention will appear more clearly from the following description of a non-limiting illustrative embodiment and the accompanying drawings in which like numerals designate like parts through the several views.

DESCRIPTION OF THE DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
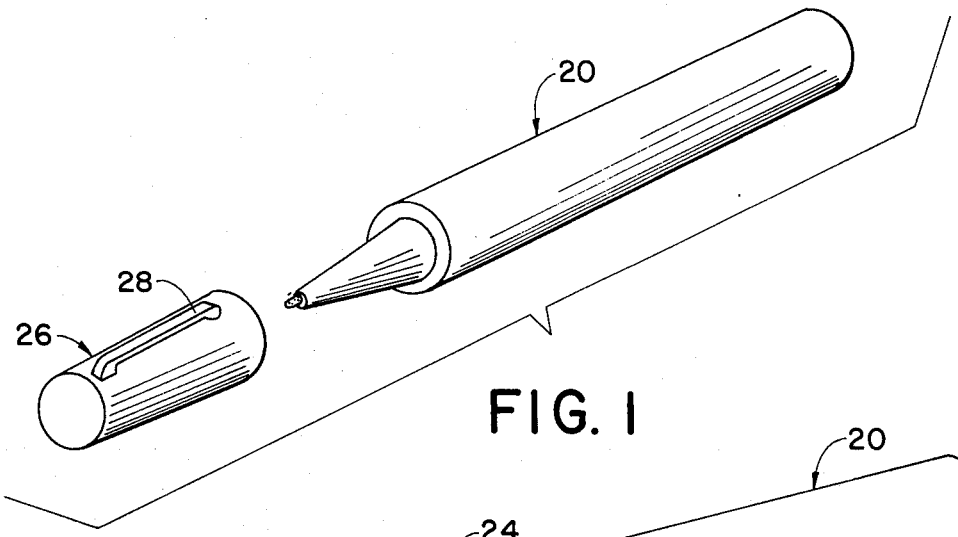
FIG. 1 is an exploded pictorial representation of the kit showing the marker tip.
Figure 2:
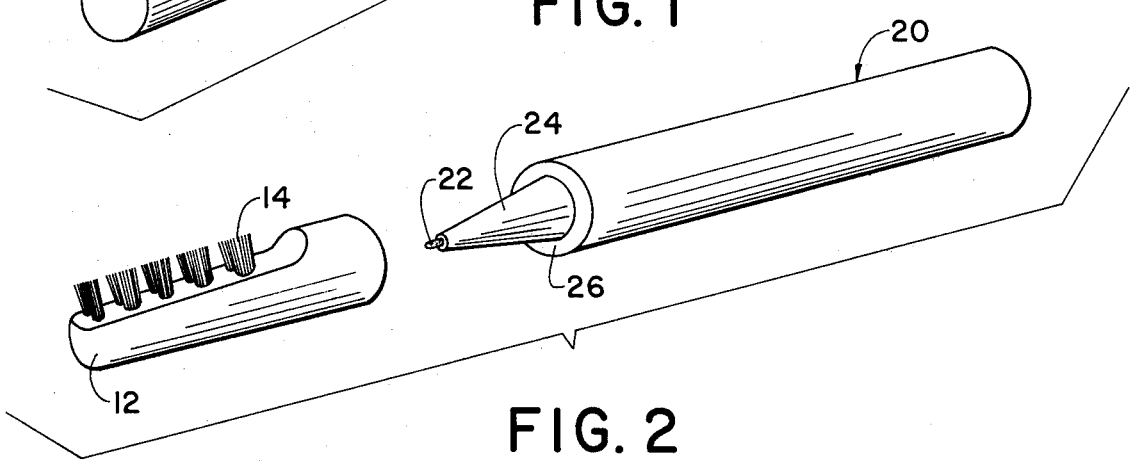
FIG. 2 is an exploded pictorial representation showing the toothbrush.
Figure 4:
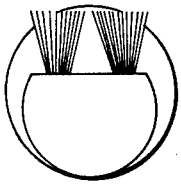
FIG. 4 is an end view taken substantially in direction 4—4 in FIG. 3.
Figure 3:
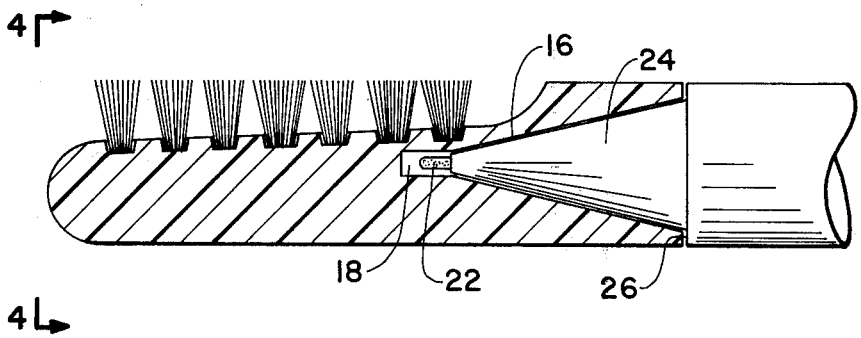
FIG. 3 is an axial sectional view thru the toothbrush head.

In the drawings a toothbrush kit embodying features of the invention is illustrated incorporating marker 20 having tip 22, brush head 12 with bristles 14, cover cap 26 with clip 28. Marker 20 tapers 24 towards tip 22 permitting insertion of taper 24 into tapered hole 16 of head 12 with enlarged hole 18 to provide clearance for tip 22. As is well known in the mechanical arts, the two tapers are fitted to hold together and to release by twisting the marker 20 relative to the head 12.

Cover cap 26 seats upon the periphery of head 12.

The marker 20 body is essentially a reservoir for chemicals which may be in liquid or semi solid form. By making the marker body adequately soft and pliable, it can be manually squeezed to promote the expulsion of chemicals thru the tip which may be a fine hole or a soft marking tip such as felt.

The chemicals in the marker may be any of those recommended for oral use in dental care, including those used to highlight plaque.

The kit can be made by known manufacturing methods of known materials, including suitable plastics.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A toothbrush kit comprising a head containing bristles which fits onto a body comprising a plaque marker provided with a felt dispensing tip and a cover for the head, the cover provided with a clip; the marker being adapted for use with and containing a liquid chemical suitable for highlighting plaque.

2. A toothbrush kit as in claim 1 wherein the marker has a body which serves as a reservoir.

3. A toothbrush kit as in claim 1 wherein the marker body is pliable to permit squeezing the reservoir.

4. A toothbrush kit as in claim 4 wherein the reservoir is refillable.

* * * * *